US009214129B2

(12) United States Patent
Kim et al.

(10) Patent No.: US 9,214,129 B2
(45) Date of Patent: Dec. 15, 2015

(54) DISPLAY APPARATUS

(71) Applicant: Samsung Display Co., Ltd., Yongin (KR)

(72) Inventors: Jeong-Young Kim, Gyeongsangbuk-do (KR); BumJin Kim, Cheonan-si (KR); Young-Joo Nam, Hwaseong-si (KR); Hyungbo Shim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 187 days.

(21) Appl. No.: 13/728,476

(22) Filed: Dec. 27, 2012

(65) Prior Publication Data

US 2014/0028639 A1 Jan. 30, 2014

(30) Foreign Application Priority Data

Jul. 25, 2012 (KR) ..... 10-2012-0081277

(51) Int. Cl.
*G09G 5/00* (2006.01)
*G09G 3/20* (2006.01)

(52) U.S. Cl.
CPC ..... *G09G 5/001* (2013.01); *G09G 3/20* (2013.01); *G09G 2300/0426* (2013.01); *G09G 2310/0267* (2013.01); *G09G 2310/0289* (2013.01)

(58) Field of Classification Search
None
See application file for complete search history.

(56) References Cited

U.S. PATENT DOCUMENTS

| | | | | |
|---|---|---|---|---|
| 5,757,635 | A | 5/1998 | Seong | |
| 2002/0118157 | A1 * | 8/2002 | Lee et al. | 345/87 |
| 2005/0179633 | A1 * | 8/2005 | Inada | 345/98 |
| 2008/0084378 | A1 * | 4/2008 | Lee et al. | 345/92 |
| 2009/0189537 | A1 | 7/2009 | Hong | |
| 2010/0103149 | A1 | 4/2010 | Lin | |
| 2010/0315406 | A1 | 12/2010 | Nose et al. | |
| 2011/0157148 | A1 | 6/2011 | Jang et al. | |

FOREIGN PATENT DOCUMENTS

| | | |
|---|---|---|
| JP | 2010-063217 | 3/2010 |
| JP | 2012-042575 | 3/2012 |
| KR | 10-0391139 | 10/2003 |
| KR | 10-0607707 | 8/2006 |
| KR | 10-0898870 | 5/2009 |
| KR | 10-2009-0059190 | 6/2009 |
| KR | 10-2009-0073456 | 7/2009 |
| KR | 10-0918653 | 9/2009 |
| KR | 10-2010-0047071 | 5/2010 |
| KR | 10-2011-0101901 | 9/2011 |

* cited by examiner

*Primary Examiner* — Joseph Haley
*Assistant Examiner* — Ifedayo Iluyomade
(74) *Attorney, Agent, or Firm* — H.C. Park & Associates, PLC

(57) ABSTRACT

A display apparatus includes a plurality of pixels each of which is connected to a corresponding gate line of a plurality of gate lines and a corresponding data line of a plurality of data lines, the plurality of data lines crossing the plurality of gate lines. The display apparatus also includes a control signal generator configured to generate a plurality of control signals in response to a date enable signal, a gate driver configured to drive the gate lines in response to at least one control signal among the plurality of control signals, a data driver configured to drive the plurality of data lines, and a timing controller configured to control the data driver in response to at least one received image signal and at least one received image control signal, and apply the data enable signal to the control signal generator.

15 Claims, 10 Drawing Sheets

DISPLAY APPARATUS

CROSS-REFERENCE TO RELATED APPLICATION

This application claims priority from and the benefit of Korean Patent Application No. 10-2012-0081277, filed on Jul. 25, 2012, which is incorporated by reference for all purposes as if set forth herein.

BACKGROUND

1. Field

Exemplary embodiments of the present disclosure relate to a display apparatus that displays an image.

2. Discussion

A display apparatus typically includes a display panel that displays an image and a driving circuit that drives the display panel. The driving circuit includes a plurality of driving circuits, such as a timing controller, a gate driver, a data driver, etc. The timing controller generates various signals required to display the image on the display panel using an image signal from an external source and applies the signals to the gate driver and the data driver.

In an effort to reduce manufacturing costs, many components of conventional display technologies are gravitating towards simpler, smaller footprint parts. Since, however, the number of signals output from the timing controller is generally increased in accordance with the variation of a driving scheme of traditional display panels, it is rather difficult and complex to downsize the timing controller.

The above information disclosed in this Background section is only for enhancement of understanding of the background of the invention and therefore it may contain information that does not form any part of the prior art nor what the prior art may suggest to a person of ordinary skill in the art.

SUMMARY

Exemplary embodiments provide a display apparatus including downsized time control technology and a method to drive the same.

Additional aspects will be set forth in the detailed description which follows and, in part, will be apparent from the disclosure, or may be learned by practice of the invention.

According to various exemplary embodiments, a display apparatus includes: a plurality of gate lines; a plurality of data lines that cross the plurality of gate lines; a plurality of pixels each of which is connected to a corresponding gate line of the plurality of gate lines and a corresponding data line of the plurality of data lines. The display apparatus also includes a control signal generator configured to generate a plurality of control signals in response to a data enable signal, a gate driver configured to drive the plurality of gate lines in response to at least one control signal among the plurality of control signals, a data driver configured to drive the plurality of data lines, and a timing controller configured to: control the data driver in response to at least one received image signal and at least one received image control signal, and apply the data enable signal to the control signal generator.

Accordingly, the control signal generator is configured to generate various signals utilized to drive the plurality of gate lines in response to one or more enable signals received from the timing controller. In this manner, the complexity and the number of pins associated with the timing controller may be reduced, so that the timing controller may be downsized. In turn, this reduction in size, complexity, and number of interworking components enables the display apparatus to be more efficiently manufactured and at reduced cost.

According to various exemplary embodiments, a method to drive a display apparatus comprising a plurality of pixels comprises: receiving at least one data enable signal generated based on an enable signal associated with an image control signal; counting, in response to reception of the at least one data enable signal, an inner clock signal; comparing the counted inner clock signal with time information; generating, based on the comparison, a vertical synchronization signal and at least two gate pulse signals; converting the vertical synchronization signal and the at least two gate pulse signals into a vertical synchronization start signal and at least two gate clock signals, respectively; and driving the plurality of pixels based on the vertical synchronization start signal and the at least two gate clock signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION

Figure 1:
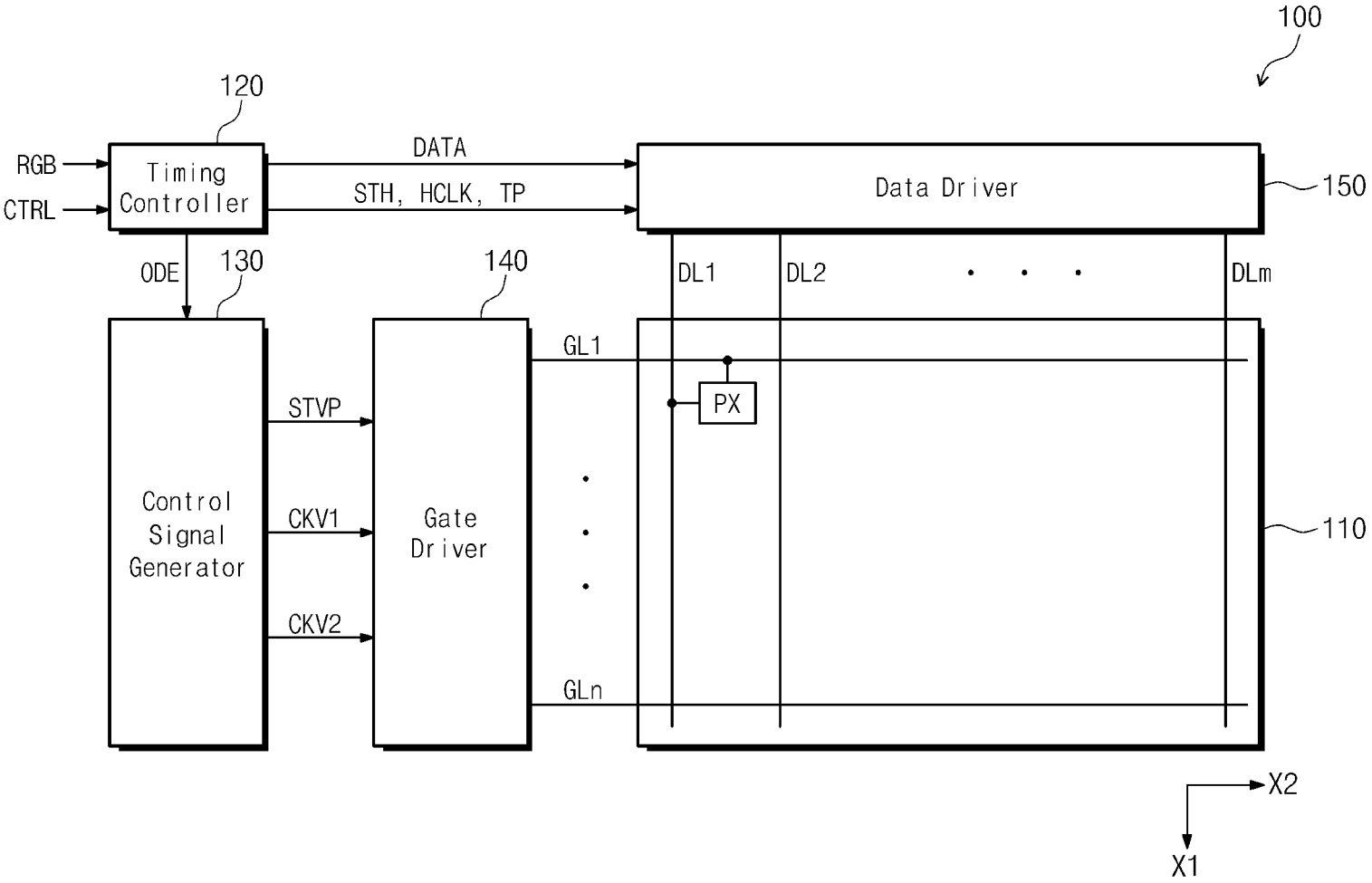
FIG. 1 is a block diagram of a display apparatus, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers and/or regions may be exaggerated for clarity and descriptive purposes. Also, like reference numerals denote like elements.

When an element or layer is referred to as being "on," "connected to," or "coupled to" another element or layer, it may be directly on, directly connected to, or directly coupled to the other element or layer, or intervening elements or layers may be present. When, however, an element is referred to as being "directly on," "directly connected to," or "directly coupled to" another element or layer, there are no intervening elements or layers present. For the purposes of this disclosure, "at least one of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, third, etc., may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section that is discussed below may be termed a second element, component, region, layer, or section without departing from the teachings of the present invention.

Spatially relative terms, such as "beneath," "below," "lower," "above," "upper," and/or the like, may be used herein for descriptive purposes and, thereby, to describe one element or feature's relationship to another element(s) or feature(s) as illustrated in the drawings. Spatially relative terms are intended to encompass different orientations of an apparatus in use or operation in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations) and, as such, the spatially relative descriptors used herein are to be interpreted accordingly.

The terminology used herein is for the purpose of describing particular embodiments only and is not intended to be limiting. As used herein, the singular forms "a," "an," and "the" are intended to include the plural forms as well, unless the context clearly indicates otherwise. Moreover, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Although various exemplary embodiments are described with respect to liquid crystal displays (LCD), it is contemplated that various exemplary embodiments are also applicable to other display technologies, such as various other self-emissive and/or non-self-emissive display technologies, e.g., light emitting diode (LED) displays, organic light emitting diode displays (OLED), plasma displays (PD), electrophoretic displays (EPD), electrowetting displays (EWD), etc.

FIG. 1 is a block diagram of a display apparatus, according to exemplary embodiments.

As shown, the display apparatus 100 includes a display panel 110, a timing controller 120, a control signal generator 130, a gate driver 140, and a data driver 150. While specific reference will be made to this particular implementation, it is also contemplated that display apparatus 100 may embody many forms and include multiple and/or alternative components or features. For example, it is contemplated that the components of display apparatus 100 may be combined, located in separate structures, and/or separate locations.

According to various exemplary embodiments, the display panel 110 includes a plurality of data lines DL1 to DLm extended in a first direction (e.g., X1), a plurality of gate lines GL1 to GLn extended in a second direction (e.g., X2) and cross the data lines DL1 to DLm, and a plurality of pixels PX. Pixels PX may be arranged in matrix form; however, it is contemplated that any other suitable arrangement may be utilized. The data lines DL1 to DLm are insulated from the gate lines GL1 to GLn.

Although not shown in FIG. 1, individual pixels PX may include a switching transistor connected to a corresponding data line of the data lines DL1 to DLm and a corresponding gate line of the gate lines GL1 to GLn, a liquid crystal capacitor connected to the switching transistor, and a storage capacitor connected to the switching transistor.

The timing controller 120 is configured to receive image signals RGB and image control signals CTRL used to control the image signals RGB, such as a vertical synchronization signal Vsync, a horizontal synchronization signal Hsync, a main clock signal MCLK, an enable signal DE, etc. The timing controller 120 is further configured to process the image signals RGB in accordance with an operation condition of the display panel 110 on the basis of the image control signals CTRL and, thereby, to output an image data signal DATA. The timing controller 120 is also configured to apply the image data signal DATA, a first start pulse signal STH, a clock signal HCLK, and a line latch signal TP to the data driver 150, and apply a data enable signal ODE to the control signal generator 130.

The control signal generator 130 is configured to generate, in response to the data enable signal ODE, a vertical synchronization start signal STVP, first clock signal CKV1, and second clock signal CKV2. One or more of these signals may be utilized to drive the gate driver 140.

The gate driver 140 is configured to drive the gate lines GL1 to GLn in response to the vertical synchronization start signal STVP, the first and second gate clock signals CKV1 and CKV2, a gate on voltage VON, and a gate off voltage VOFF, which are received from the control signal generator 130. According to various exemplary embodiments, the gate driver 140 is configured as (or part of) a gate driver integrated circuit or a circuit comprising one or more oxide semiconductors, amorphous semiconductors, crystalline semiconductors, polycrystalline semiconductors, and/or the like.

The data driver 150 is configured to output one or more gray-scale voltages in response to the image data signal DATA, the first start pulse signal STH, the clock signal HCLK, and the line latch signal TP, which are received from the timing controller 120. The gray-scale voltage(s) may be utilized to drive the data lines DL1 to DLm.

Accordingly, when the gate on voltage VON is applied to one gate line of the gate lines GL1 to GLn by the gate driver 140, switching transistors arranged in one row and connected to the one gate line are turned on. The data driver 150 is configured to provide the gray-scale voltages corresponding to the image data signal DATA to the data lines DL1 to DLm. The gray-scale voltages applied to the data lines DL1 to DLm are applied to corresponding liquid crystal capacitors (not shown) and corresponding storage capacitors (not illustrated) via the "turned-on" switching transistors of corresponding pixels PX connected to the one gate line. In this manner, a period in which the switching transistors corresponding to one row of pixels PX are "turned-on," may be referred to as "one horizontal period" or "1H." It is noted that this "period" is, for example, one period of the enable signal DE.

Figure 2:
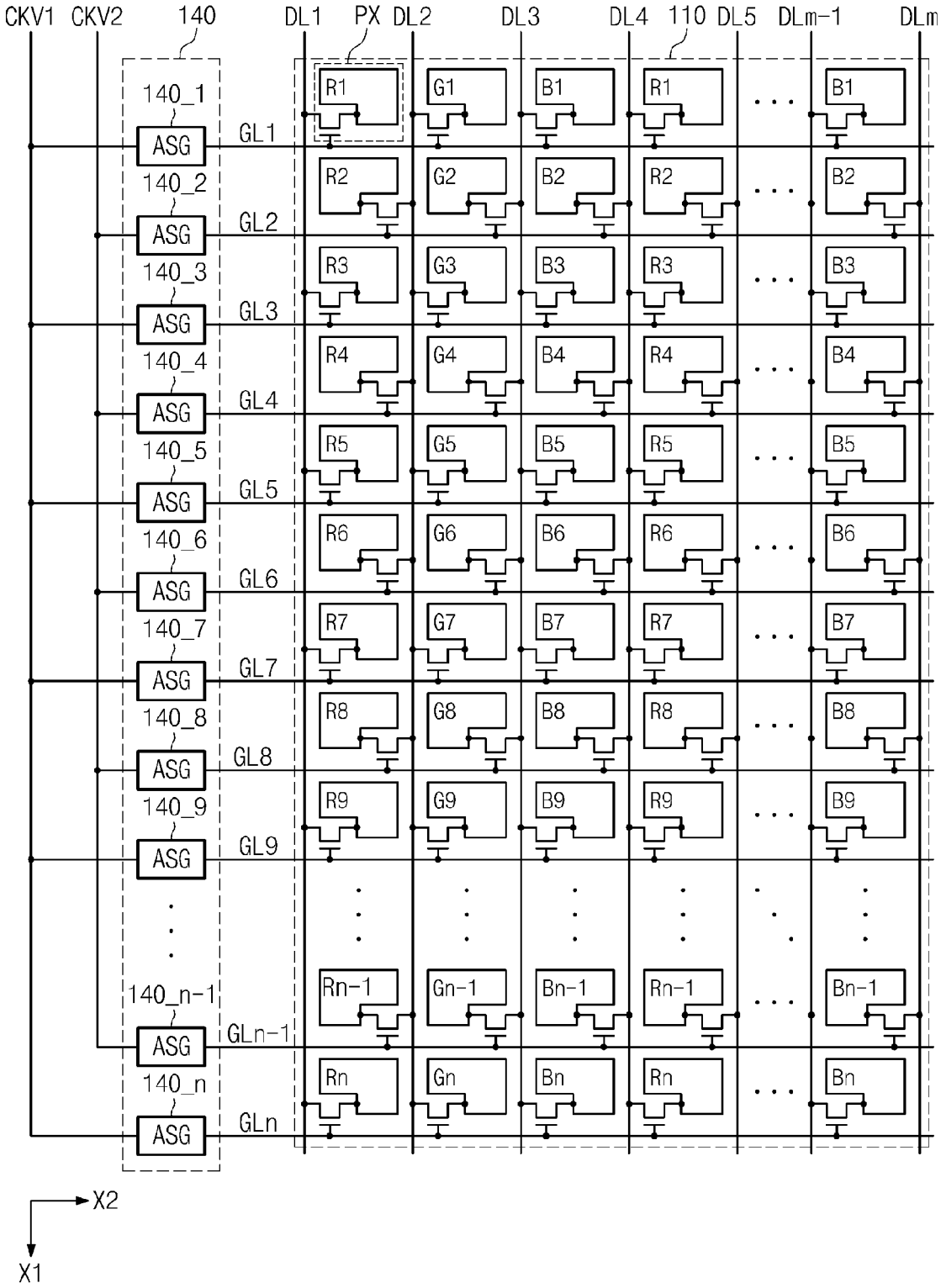
FIG. 2 schematically illustrates a gate driver configuration and a pixel arrangement of the display apparatus of FIG. 1, according to exemplary embodiments.

FIG. 2 schematically illustrates a gate driver configuration and a pixel arrangement of the display apparatus of FIG. 1, according to exemplary embodiments. It is noted that FIG. 2 depicts display panel 110 and the gate driver 140 being operated in response to the first and second gate clock signals CKV1 and CKV2, but it is contemplated that various other and/or additional configurations of the gate driver 140 and the display panel 110 may be utilized.

According to various exemplary embodiments, the gate driver 140 includes a plurality of amorphous silicon gate (ASG) circuits 140_1 to 140_*n* respectively corresponding to the gate lines GL1 to GLn. Although the gate driver 140 is described as including the ASG circuits 140_1 to 140_*n*, exemplary embodiments of the gate driver 140 are not to be limited thereto or thereby. For instance, the gate driver 140 may be mounted to a side portion of the display panel 110.

While not illustrated, individual pixels PX of the display panel 110 may, according to one exemplary implementation, include one of red, green, and blue pixels R, G, and B and may be coupled to corresponding pixel electrodes, as well as include a switching transistor. For descriptive purposes, the pixel corresponding to the red, the pixel corresponding to the green, and the pixel corresponding to the blue are referred to, hereinafter, as a red pixel, a green pixel, and a blue pixel, respectively. It is contemplated, however, that individual pixels may be additionally and/or alternatively configured.

As previously mentioned, each switching transistor is connected to a corresponding data line of the data lines DL1 to DLm and a corresponding gate line of the gate lines GL1 to GLn. The pixels PX may be sequentially arranged in, for instance, the second direction X2 in which the gate lines GL1 to GLn are extended. The pixels PX having the same color may be arranged in, for example, the first direction X1 in which the data lines DL1 to DLm are extended. For instance, red pixels R1 to Rn are arranged on a right side of the data line DL1, green pixels G1 to Gn are arranged between the data lines DL2 and DL3, and blue pixels B1 to Bn are arranged between the data lines DL3 and DL4. Although the red pixel R, the green pixel G, and the blue pixel B are shown as being sequentially arranged in the second direction X2 in which the gate lines GL1 to GLn are extended, additional and/or alternative arrangements are contemplated. For instance, the red, green, and blue pixels R, G, and B may be arranged in the order of R-B-G, G-B-R, G-R-B, B-R-G, B-G-R, etc.

As seen in FIG. 2, a first group of the pixels R1 to Rn, G1 to Gn, and B1 to Bn is connected to the left-side data line and a second group of the pixels R1 to Rn, G1 to Gn, and B1 to Bn is connected to the right-side data line. For instance, the switching transistors of the pixels connected to odd-numbered gate lines GL1, GL3, GL5, . . . , GLn-1 may be connected to the left-side data line, and the switching transistors of the pixels connected to even-numbered gate lines GL2, GL4, GL6, . . . , GLn may be connected to the right-side data line. Accordingly, the pixels may be, in certain exemplary embodiments, alternately connected to the left-side data line and the right-side data line in unit rows, e.g., in a zigzag shape.

For example, each of the switching transistors of the pixels connected to the gate line GL1 is connected to the left-side data line, and each of the switching transistors of the pixels connected to the gate line GL2 is connected to the right-side data line.

Among the ASG circuits 140_1 to 140_*n*, odd-numbered ASG circuits 140_1, 140_3, . . . , 140_*n*-1 are operated in synchronization with the first gate clock signal CKV1 received from the control signal generator 130 of FIG. 1. Among the ASG circuits 140_1 to 140_*n*, even-numbered ASG circuits 140_2, 140_4, . . . , 140_*n* are operated in synchronization with the second gate clock signal CKV2 received from the control signal generator 130.

Figure 3:
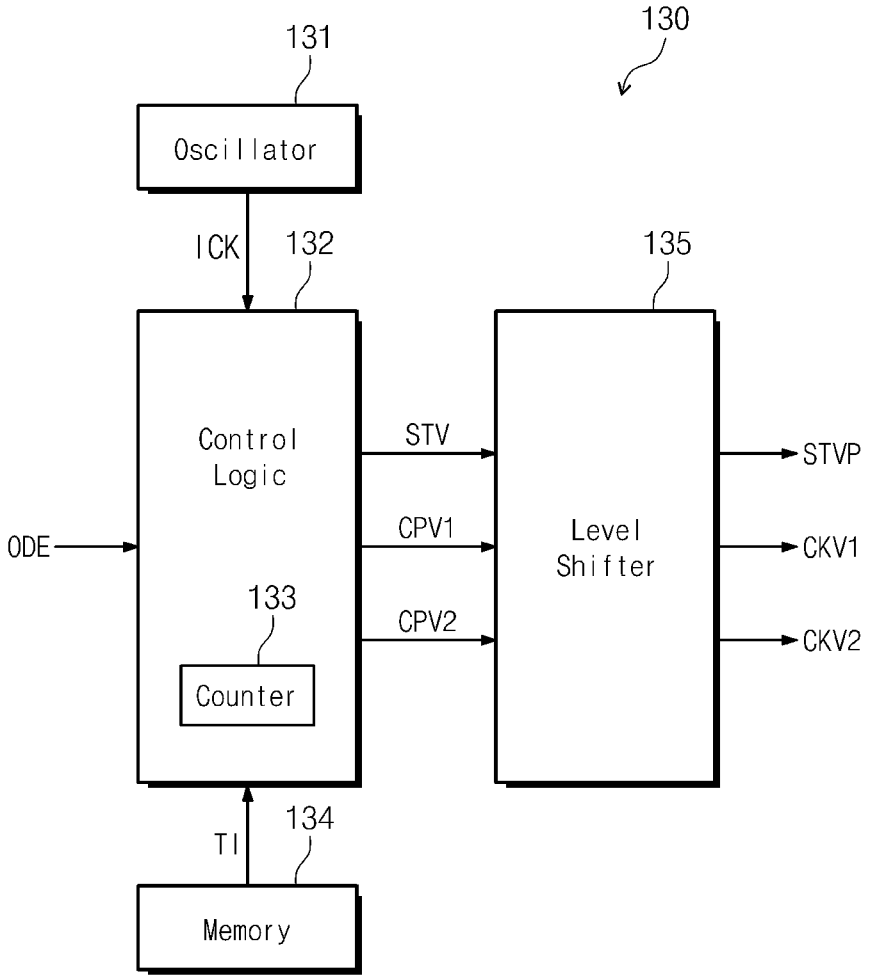
FIG. 3 is a block diagram of the control signal generator of the display apparatus of FIG. 1, according to exemplary embodiments.

FIG. 3 is a block diagram of the control signal generator 130 of the display apparatus 100 of FIG. 1, according to exemplary embodiments.

Referring to FIG. 3, the control signal generator 130 includes an oscillator 131, a control logic 132, a memory 134, and a level shifter 135. While specific reference will be made to this particular implementation, it is also contemplated that control signal generator 130 may embody many forms and include multiple and/or alternative components or features. For example, it is contemplated that the components of control signal generator 130 may be combined, located in separate structures, and/or separate locations. The oscillator 131 is configured to generate an inner clock signal ICK exhibiting a predetermined frequency. The memory 134 is configured to store time information TI related to the vertical synchronization signal STV and the first and second gate pulse signals CPV1 and CPV2. To this end, memory 134 may include volatile and/or non-volatile memory, such as erasable programmable read-only memory (EPROM), electrically erasable programmable read-only memory (EEPROM), flash memory, random access memory (RAM), read only memory (ROM), etc., as well as include any other suitable dynamic and/or static storage device. Further, memory 134 may be implemented as one or more discrete devices, stacked devices, and/or integrated with control logic 132.

According to exemplary embodiments, the control logic 132 is configured to count the inner clock signal ICK received from the oscillator 131 in synchronization with the data enable signal ODE received from the timing controller 120 of the display apparatus 100 of FIG. 1. In this manner, the control logic 132 is also configured to compare the counted value of the inner clock signal ICK and the time information TI stored in the memory 134 to generate the vertical synchronization signal STV and the first and second gate pulse signals CPV1 and CPV2. It is also noted that the control logic 132 includes a counter 133 to count the inner clock signal ICK received from the oscillator 131.

According to various exemplary embodiments, control logic 132 may be implemented via software, hardware, firmware, or a combination thereof. For instance, control logic 132 may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

Level shifter 135, in exemplary embodiments, is configured to convert the vertical synchronization signal STV and the first and second gate pulse signals CPV1 and CPV2 received from the control logic 132 to allow the vertical synchronization signal STV and the first and second gate pulse signals CPV1 and CPV2 to exhibit a sufficient voltage level to drive the gate driver 140 of the display apparatus 100. It is also noted that level shifter 135 is configured to output the vertical synchronization start signal STVP and the first and second gate clock signals CKV1 and CKV2. For instance, the vertical synchronization signal STV and the first and second gate pulse signals CPV1 and CPV2 may be swung in a range of about 0.2 volts to about 3.1 volts, and the vertical synchronization start signal STVP and the first and second gate clock signals CKV1 and CKV2 may be swung in a range of about −14 volts to about 20 volts.

Figure 4:
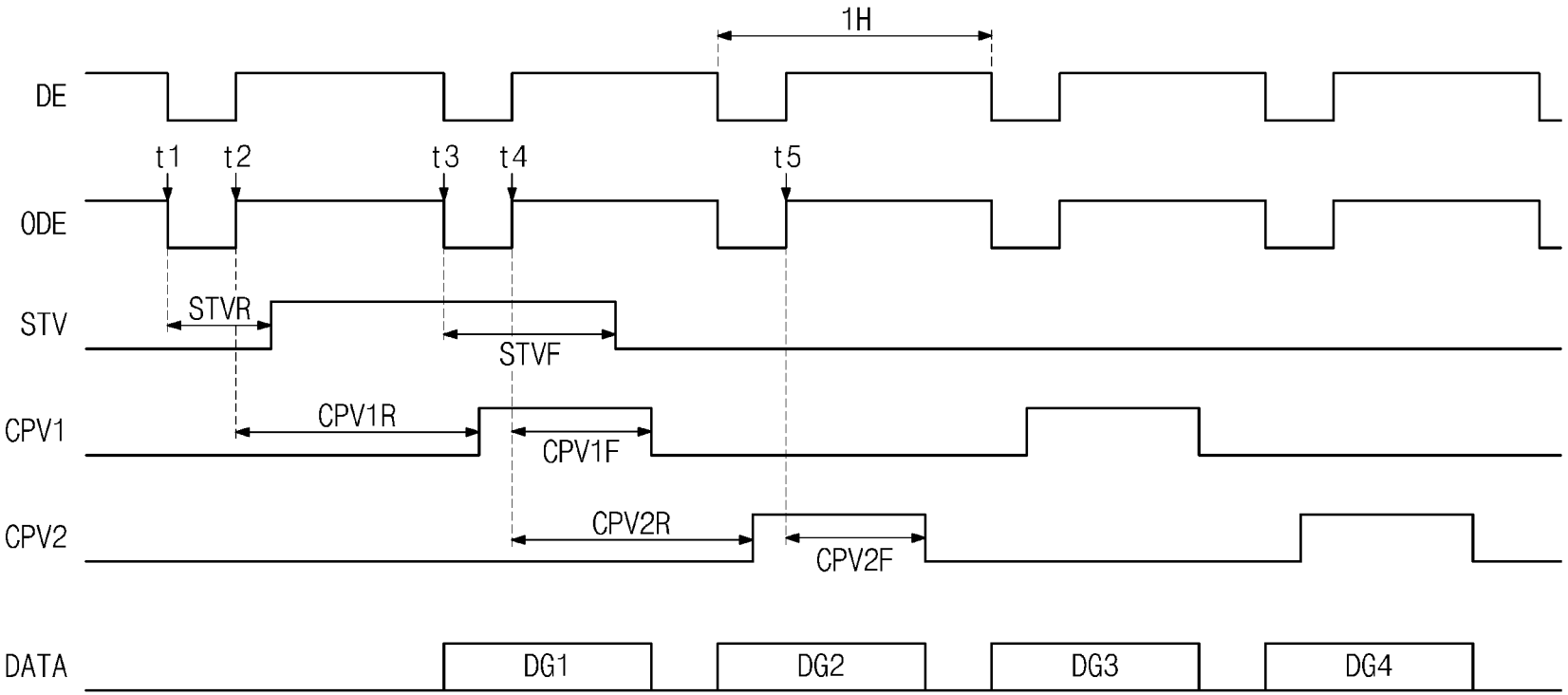
FIG. 4 is a timing diagram of various components associated with the display apparatus of FIG. 1, according to exemplary embodiments.

FIG. 4 is a timing diagram of various components associated with the display apparatus of FIG. 1, according to exemplary embodiments.

With reference to FIGS. 1, 3, and 4, the timing controller 120 is configured to output the data enable signal ODE in response to the enable signal DE included in the image control signals CTRL. The data enable signal ODE exhibits a frequency the same as or integer multiple of the enable signal DE. In FIG. 4, the data enable signal ODE exhibits the same frequency as the enable signal DE. One period of the enable signal DE corresponds to one horizontal period 1H. The one horizontal period 1H corresponds to a time period in which the pixels connected to an associated gate line of the display panel 110 are driven.

The pulse shape of vertical synchronization signal STV and the first and second gate pulse signals CPV1 and CPV2, which are generated by the control logic 132, may be generated as follows. For instance, in response to a vertical synchronization rising time STVR lapsing from a first time point t1 at which the data enable signal ODE is transited to a low level from a high level, the vertical synchronization signal STV is transited to a high level from a low level. In response to a vertical synchronization falling time STVF lapsing from a third time point t3 at which the data enable signal ODE is transited to the low level from the high level, the vertical synchronization signal STV is transited to the low level from the high level.

It is also noted that the first gate pulse signal CPV1 is transited to a high level from a low level in response to a first gate pulse rising time CPV1R lapsing from a second time point t2 at which the data enable signal ODE is transited to the high level from the low level. The first gate pulse signal CPV1 is transited to the low level from the high level in response to a first gate pulse falling time CPV1F lapsing from a fourth time point t4 at which the data enable signal ODE is transited to the high level from the low level.

Further, the second gate pulse signal CPV2 is transited to a high level from a low level in response to a second gate pulse rising time CPV2R lapsing from the fourth time point t4 at which the data enable signal ODE is transited to the high level from the low level. The second gate pulse signal CPV2 is transited to the low level from the high level in response to a second gate pulse falling time CPV2F lapsing from a fifth time point t5 at which the data enable signal ODE is transited to the high level from the low level.

The vertical synchronization rising time STVR, the vertical synchronization falling time STVF, the first gate pulse rising time CPV1R, the first gate pulse falling time CPV1F, the second gate pulse rising time CPV2R, and the second gate pulse falling time CPV2F may be stored in the memory 134. Accordingly, the timing of the vertical synchronization signal STV and the first and second gate pulse signals CPV1 and CPV2 may be controlled via static and/or dynamic configuration of the time information STVR, STVF, CPV1R, CPV1F, CPV2R, and CPV2F.

According to exemplary embodiments, the control signal generator 130 may be configured to generate the vertical synchronization start signal STVP and the first and second gate clock signals CKV1 and CKV2 in response to the data enable signal ODE. In this manner, the timing controller 120 may be configured to only apply the data enable signal ODE to the control signal generator 130. As a result, the timing controller 120 may be configured without a separate circuit block conventionally utilized to generate the vertical synchronization start signal STVP and the first and second gate clock signals CKV1 and CKV2 and, as such, the size of the circuit and the number of pins associated with the timing controller 120 may be reduced. In turn, this reduction in size, complexity, and number of interworking components enables the display apparatus 100 to be more efficiently manufactured and at reduced cost.

Figure 5:
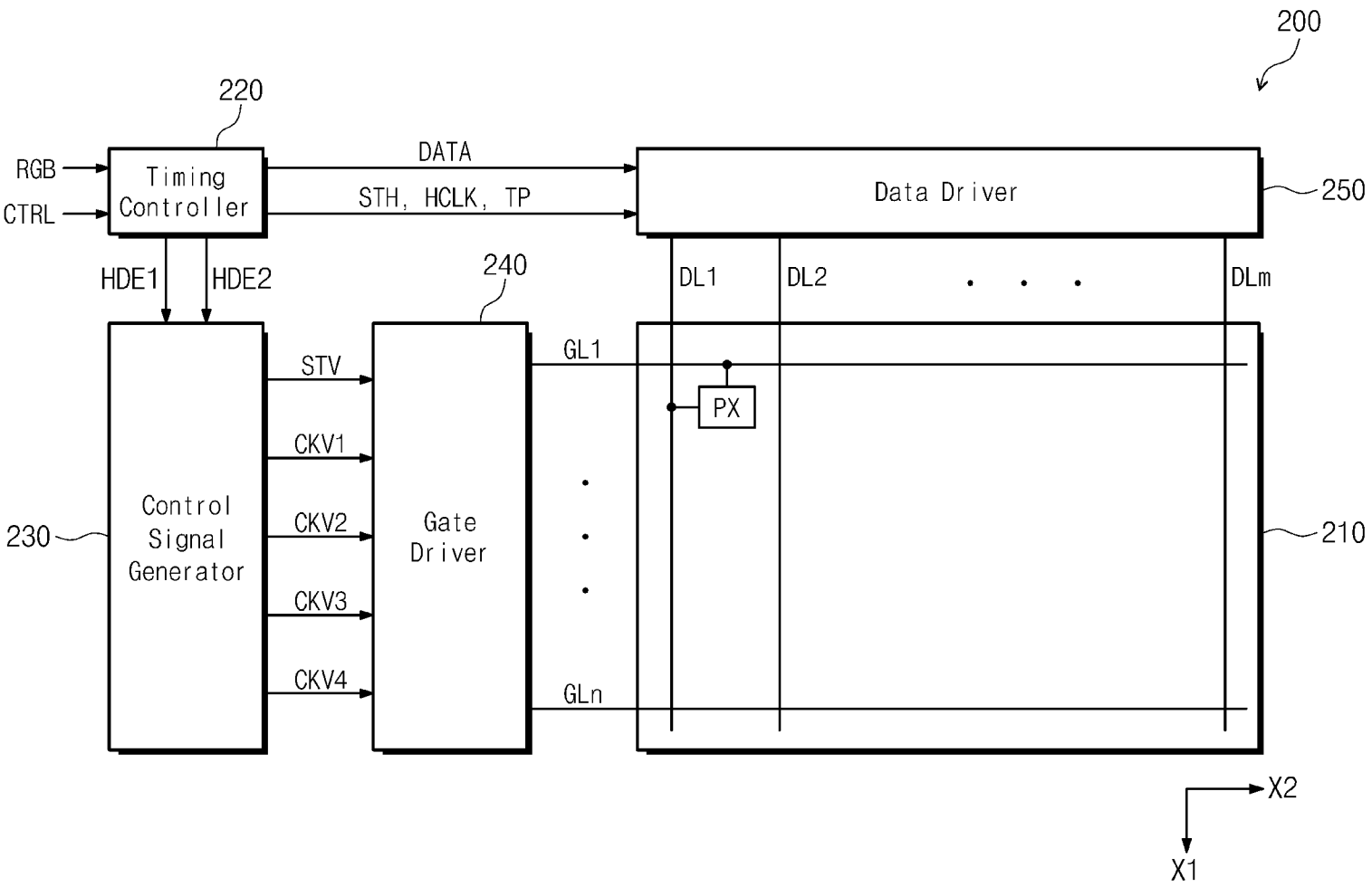
FIG. 5 is a block diagram of a display apparatus, according to exemplary embodiments.

FIG. 5 is a block diagram of a display apparatus, according to exemplary embodiments.

As shown, the display apparatus 200 includes a display panel 210, a timing controller 220, a control signal generator 230, a gate driver 240, and a data driver 250. While specific reference will be made to this particular implementation, it is also contemplated that display apparatus 200 may embody many forms and include multiple and/or alternative components or features. For example, it is contemplated that the components of display apparatus 200 may be combined, located in separate structures, and/or separate locations. Further, it is noted that the detailed descriptions of similar components as those in display apparatus 100 of FIG. 1 are omitted in order to avoid redundancy.

According to exemplary embodiments, the timing controller 220 is configured to receive image signals RGB and control signals CTRL, which may be used to control the image signals RGB, such as a vertical synchronization signal Vsync, a horizontal synchronization signal Hsync, a main clock signal MCLK, an enable signal DE, and/or the like. The timing controller 220 is configured to apply (or otherwise transmit) first and second data enable signals HDE1 and HDE2 to the control signal generator 230.

In response to one or more of the first and second data enable signals HDE1 and HDE2, the control signal generator 230 is configured to generate a vertical synchronization start signal STVP, as well as first, second, third, and fourth gate clock signals CKV1, CKV2, CKV3, and CKV4, which may be utilized to drive the gate driver 240.

Figure 6:
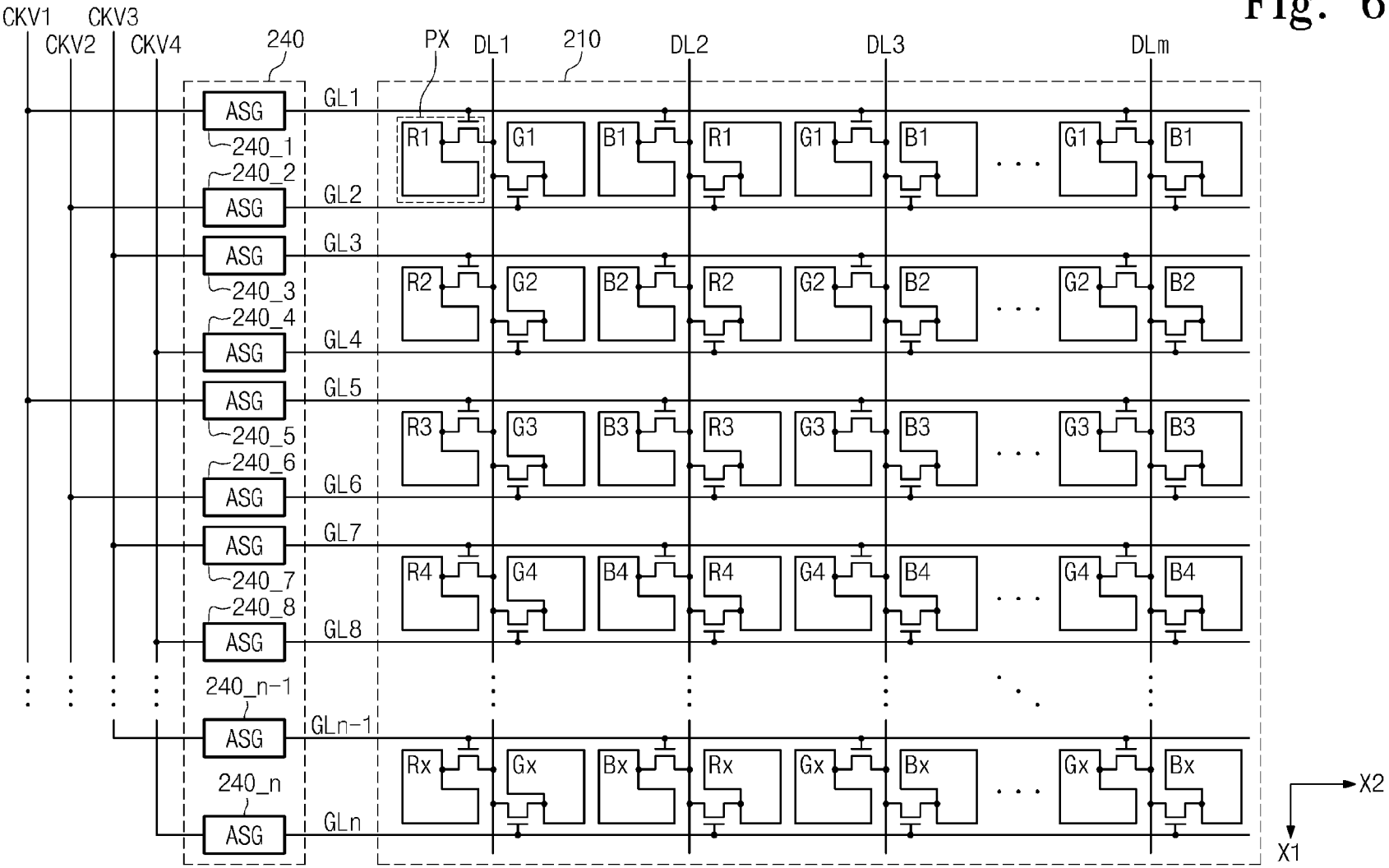
FIG. 6 schematically illustrates a gate driver configuration and a pixel arrangement of the display apparatus of FIG. 5, according to exemplary embodiments.

FIG. 6 schematically illustrates a gate driver configuration and a pixel arrangement of the display apparatus of FIG. 5, according to exemplary embodiments. It is noted that FIG. 6 depicts display panel 210 and gate driver 240 being operated in response to the first, second, third, and fourth gate clock signals CKV1, CKV2, CKV3, and CKV4, but it is contemplated that various other and/or additional configurations of the gate driver 240 and the display panel 210 may be utilized.

According to various exemplary embodiments, the gate driver 240 includes a plurality of amorphous silicon gate (ASG) circuits 240_1 to 240_*n* respectively corresponding to the gate lines GL1 to GLn. Although the gate driver 240 is described as including the ASG circuits 240_1 to 240_*n*, exemplary embodiments of the gate driver 240 are not to be limited thereto or thereby. For instance, the gate driver 240 may be mounted to a side portion of the display panel 210.

While not illustrated, individual pixels PX of the display panel 210 may, according to one exemplary embodiment, include one of red, green, and blue pixels R, G, and B and may be coupled to corresponding pixel electrodes, as well as include a switching transistor. For descriptive purposes, the pixel corresponding to the red, the pixel corresponding to the green, and the pixel corresponding to the blue are referred to, hereinafter, as a red pixel, a green pixel, and a blue pixel, respectively. It is contemplated, however, that individual pixels may be additionally and/or alternatively configured.

As previously mentioned, each switching transistor is connected to a corresponding data line of the data lines DL1 to DLm and a corresponding gate line of the gate lines GL1 to GLn. The pixels PX may be sequentially arranged in, for instance, the second direction X2 in which the gate lines GL1 to GLn are extended. The pixels PX having the same color may be arranged in, for example, the first direction X1 in which the data lines DL1 to DLm are extended. For instance, red pixels R1 to Rx are arranged on a left side of the data line DL1, whereas green pixels G1 to Gx and blue pixels B1 to Bx are arranged between the data lines DL1 and DL2. Further, the red pixels R1 to Rx and the green pixels G1 to Gn are arranged between the data lines DL2 and DL3. As noted in association with FIG. 2, it is contemplated that additional and/or alternative pixel arrangements are contemplated, such as described below.

In any event, the gate lines GL1 to GLn may be located at upper and lower sides of the pixels, respectively. That is, the number of the gate lines GL1 to GLn may be two times greater than the number of the pixels arranged in the first direction X1.

Among the pixels arranged in the second direction X2 in which the gate lines GL1 to GLn are extended, odd-numbered pixels are extended and connected to the gate line located at the upper side of the pixels, and even-numbered pixels are extended and connected to the gate line located at the lower side of the pixels. For instance, the switching transistors of odd-numbered pixels R1, B1, and G1 arranged in a first row of the display panel 210 are connected to the gate line GL1, and the switching transistors of even-numbered pixels G1, R1, and B1 arrange in the first row of the display panel 210 are connected to the gate line GL2. Similarly, the switching transistors of odd-numbered pixels R2, B2, and G2 arranged in a second row of the display panel 210 are connected to the gate line GL3, and the switching transistors of even-numbered pixels G2, R2, and B2 arrange in the second row of the display panel 210 are connected to the gate line GL4.

As seen in FIG. 6, the red pixel R, the green pixel G, and the blue pixel B may be sequentially arranged in the second direction X2 in which the gate lines GL1 to GLn are extended, but it is contemplated that additional and/or other suitable arrangements may be utilized. That is, the red, green, and blue pixels R, G, and B may be arranged in the order of R-B-G, G-B-R, G-R-B, B-R-G, B-G-R, etc.

According to various exemplary embodiments, each of the data lines DL1 to DLm is disposed between two pixels in the second direction X2. For instance, the data line D1 is disposed between the red pixels R1 to Rx and the green pixels G1 to Gx, and the red pixels R1 to Rx and the green pixels G1 to Gx are connected to the data line D1. The data line D2 is disposed between the blue pixels B1 to Bx and the red pixels R1 to Rx, and the blue pixels B1 to Bx and the red pixels R1 to Rx are connected to the data line D2.

Among the ASG circuits 240_1 to 240_*n*, first ASG circuits 240_1, 240_5, . . . , 240_*n*-3 are operated in synchronization with the first gate clock signal CKV1 received from the control signal generator 230 of FIG. 5. Among the ASG circuits 240_1 to 240_*n*, second ASG circuits 240_2, 240_6, . . . , 240_*n*-2 are operated in synchronization with the second gate clock signal CKV2 received from the control signal generator 230. Among the ASG circuits 240_1 to 240_*n*, third ASG circuits 240_3, 240_7, . . . , 240_*n*-1 are operated in synchronization with the third gate clock signal CKV3 received from the control signal generator 230. Among the ASG circuits 240_1 to 240_*n*, fourth ASG circuits 240_4, 240_8, . . . , 240_*n* are operated in synchronization with the fourth gate clock signal CKV4 received from the control signal generator 230. According to exemplary embodiments, each of the ASG circuits 240_1 to 240_*n* may be operated in synchronization with two or more signals associated with the first to fourth gate clock signals CKV1 to CKV4.

Figure 7:
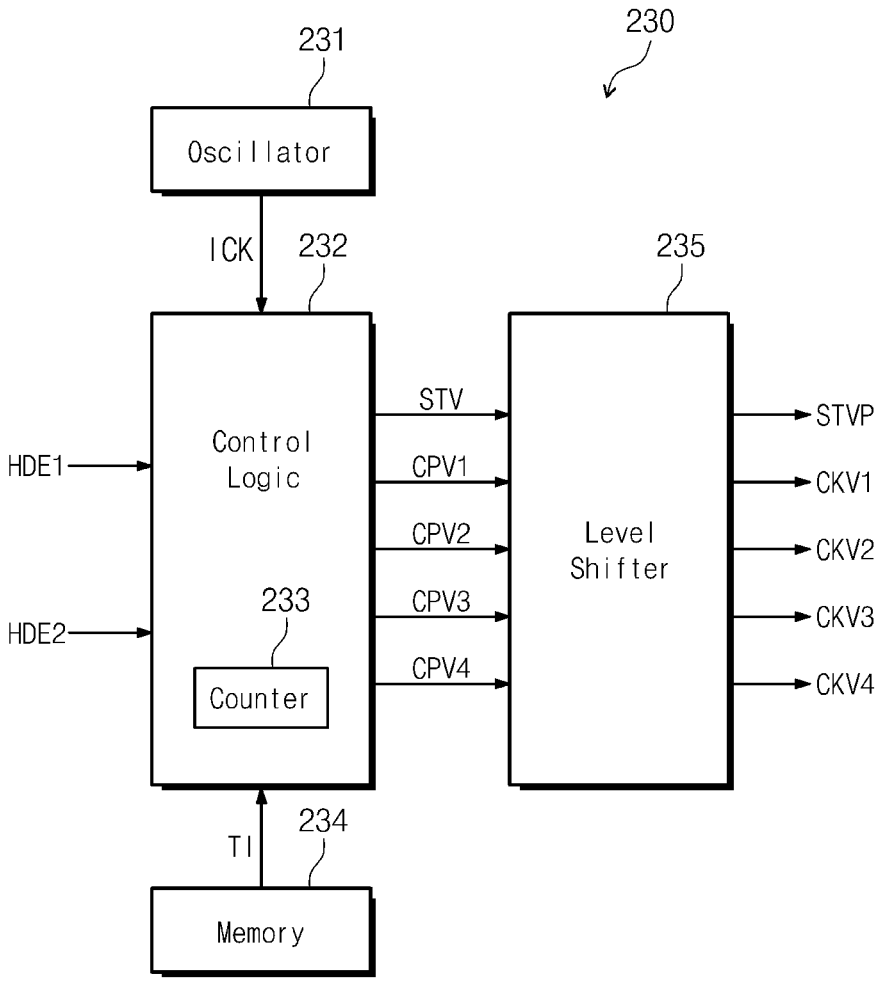
FIG. 7 is a block diagram of the control signal generator of the display apparatus of FIG. 5, according to exemplary embodiments.

FIG. 7 is a block diagram of the control signal generator of the display apparatus of FIG. 5, according to exemplary embodiments.

Referring to FIG. 7, the control signal generator 230 includes an oscillator 231, a control logic 232, a memory 234, and a level shifter 235. While specific reference will be made to this particular implementation, it is also contemplated that control signal generator 230 may embody many forms and include multiple and/or alternative components or features. For example, it is contemplated that the components of control signal generator 230 may be combined, located in separate structures, and/or separate locations. The oscillator 231 is configured to generate an inner clock signal ICK exhibiting a predetermined frequency. The memory 234 is configured to store time information TI related to the vertical synchronization signal STV and the first, second, third, and fourth gate pulse signals CPV1, CPV2, CPV3, and CPV4.

According to exemplary embodiments, the control logic 232 is configured to count the inner clock signal ICK received from the oscillator 231 in synchronization with the first and second data enable signals HDE1 and HDE2 received from the timing controller 220 of the display apparatus 200 of FIG. 5. In this manner, the control logic 232 is also configured to compare the counted value of the inner clock signal ICK and the time information TI stored in the memory 230 to generate the vertical synchronization signal STV and the first, second, third, and fourth gate pulse signals CPV1, CPV2, CPV3, and CPV4. It is also noted that the control logic 232 includes a counter 233 to count the inner clock signal ICK received from the oscillator 231.

Similarly to control logic 132, control logic 232 may, according to exemplary embodiments, be implemented via software, hardware, firmware, or a combination thereof. For instance, control logic 232 may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like. Further, memory 234 may include volatile and/or non-volatile memory, such as erasable programmable read-only memory (EPROM), electrically erasable programmable read-only memory (EEPROM), flash memory, random access memory (RAM), read only memory (ROM), etc., as well as include any other suitable dynamic and/or static storage device. To this end, memory 234 may be implemented as one or more discrete devices, stacked devices, and/or integrated with control logic 232.

Level shifter 235, in exemplary embodiments, is configured to convert the vertical synchronization signal STV and the first, second, third, and fourth gate pulse signals CPV1, CPV2, CPV3, and CPV4 received from the control logic 232 to allow the vertical synchronization signal STV and the first, second, third, and fourth gate pulse signals CPV1, CPV2, CPV3, and CPV4 to exhibit a sufficient voltage level to drive the gate driver 240 of the display apparatus 20. It is noted that the level shifter 235 is configured to output the vertical synchronization start signal STVP and the first, second, third, and fourth gate clock signals CKV1, CKV2, CKV3, and CKV4. For instance, the vertical synchronization signal STV and the first, second, third, and fourth gate pulse signals CPV1, CPV2, CPV3, and CPV4 may be swung in a range of about 0.2 volts to about 3.1 volts, and the vertical synchronization start signal STVP and the first, second, third, and fourth gate clock signals CKV1, CKV2, CKV3, and CKV4 may be swung in a range of about −14 volts to about 20 volts.

Figure 8:
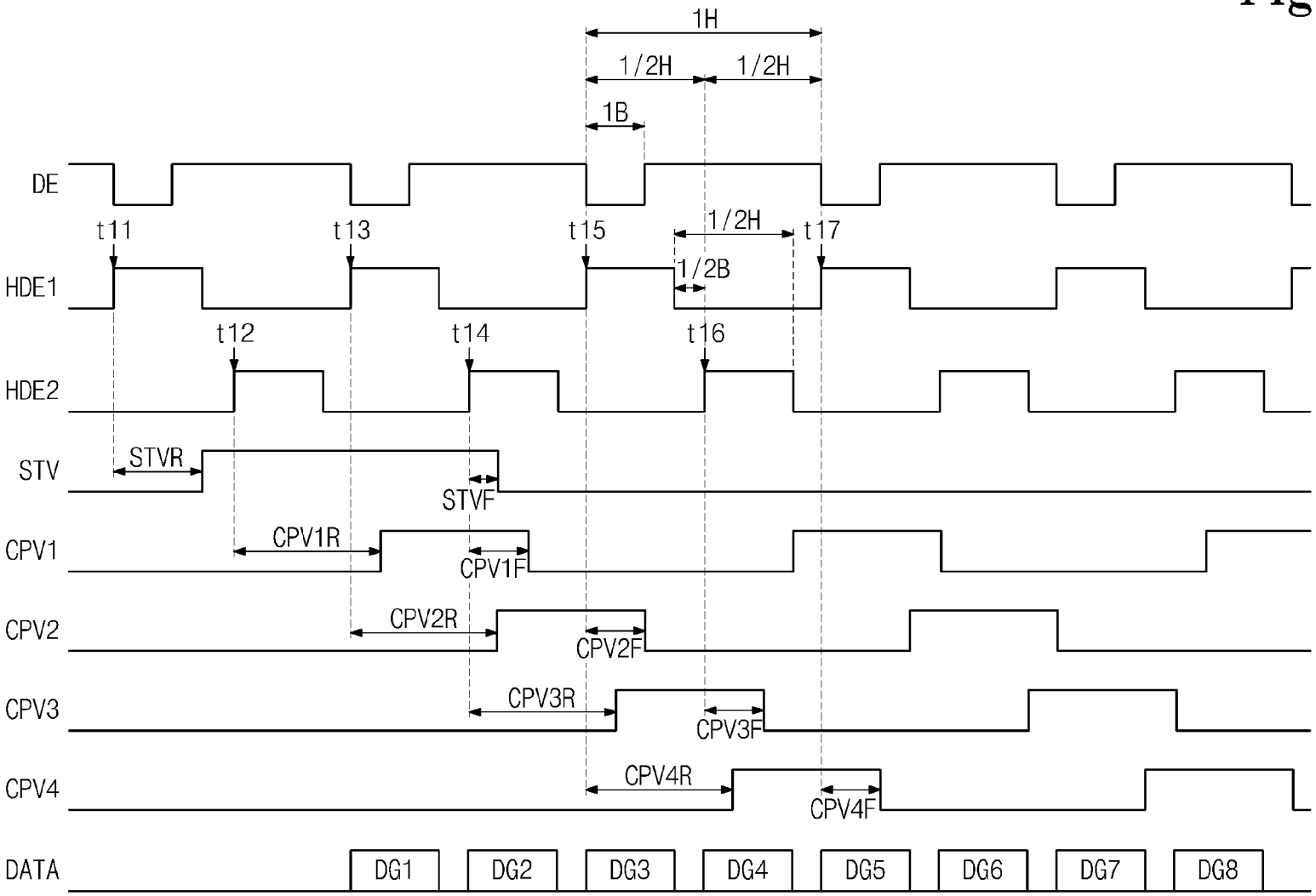
FIG. 8 is a timing diagram of various components associated with the display apparatus of FIG. 5, according to exemplary embodiments.

FIG. 8 is a timing diagram of various components associated with the display apparatus of FIG. 5, according to exemplary embodiments.

With reference to FIGS. 5, 7, and 8, the timing controller 220 is configured to output the first and second data enable signals HDE1 and HDE2 in response to the enable signal DE included in the image control signals CTRL. The first and second data enable signals HDE1 and HDE2 exhibit a frequency the same as or integer multiple of the enable signal DE. As seen in FIG. 8, the first and second data enable signals HDE1 and HDE2 exhibit the same frequency as the enable signal DE. One period of the enable signal DE corresponds to one horizontal period 1H. The one horizontal period 1H corresponds to a time period in which the pixels connected to an associated gate line of the display panel 210 are driven. Each of the first and second data enable signals HDE1 and HDE2 exhibits a high level period shorter than a half (H/2) of the one horizontal period 1H. A time period during which the first data enable signal HDE1 is transited to the high level from the low level after the first data enable signal HDE1 is transited to the low level from the high level corresponds to a half of a low level period of the enable signal DE.

The pulse shape of each of the vertical synchronization signal STV and the first, second, third, and fourth gate pulse signals CPV1, CPV2, CPV3, and CPV4, which are generated by the control logic 232, may be generated as follows. For instance, the vertical synchronization signal STV is transited to the high level from the low level in response to a vertical synchronization rising time STVR lapsing from a first time point t11 at which the first data enable signal HDE1 is transited the high level from the low level. The vertical synchronization signal STV is transited to the low level from the high level in response to a vertical is synchronization falling time STVF lapsing from a fourth time point t14 at which the second data enable signal HDE2 is transited the high level from the low level.

It is noted that the first gate pulse signal CPV1 is transited to the high level from the low level in response to a first gate pulse rising time CPV1R lapsing from a second time point t12 at which the second data enable signal HDE2 is transited to the high level from the low level. The first gate pulse signal CPV1 is transited to the low level from the high level in response to a first gate pulse falling time CPV1F lapsing from the fourth time point t14 at which the second data enable signal HDE2 is transited to the high level from the low level.

Further, the second gate pulse signal CPV2 is transited to the high level from the low level in response to a second gate pulse rising time CPV2R lapsing from a third time point t13 at which the first data enable signal HDE1 is transited to the high level from the low level. The second gate pulse signal CPV2 is transited to the low level from the high level in response to a second gate pulse falling time CPV2F lapsing from a fifth time point t15 at which the first data enable signal HDE1 is transited to the high level from the low level.

Moreover, the third gate pulse signal CPV3 is transited to the high level from the low level in response to a third gate pulse rising time CPV3R lapsing from the fourth time point t14 at which the second data enable signal HDE2 is transited to the high level from the low level. The third gate pulse signal CPV3 is transited to the low level from the high level in response to a third gate pulse falling time CPV3F lapsing from a sixth time point t16 at which the second data enable signal HDE2 is transited to the high level from the low level.

Also, the fourth gate pulse signal CPV4 is transited to the high level from the low level in response to a fourth gate pulse rising time CPV4R lapsing from the fifth time point t15 at which the first data enable signal HDE1 is transited to the high level from the low level. The fourth gate pulse signal CPV4 is transited to the low level from the high level in response to a fourth gate pulse falling time CPV4F lapsing from a seventh time point t17 at which the first data enable signal HDE1 is transited to the high level from the low level.

According to various exemplary embodiments, the vertical synchronization rising time STVR, the vertical synchronization falling time STVF, the first gate pulse rising time CPV1R, the first gate pulse falling time CPV1F, the second gate pulse rising time CPV2R, the second gate pulse falling time CPV2F, the third gate pulse rising time CPV3R, the third gate pulse falling time CPV3F, the fourth gate pulse rising time CPV4R, and the fourth gate pulse falling time CPV4F may be stored in the memory 234. Accordingly, the timing of the first, second, third, and fourth gate pulse signals CPV1, CPV2, CPV3, and CPV4 may be controlled via static and/or dynamic configuration of the time information STVR, STVF, CPV1R, CPV1F, CPV2R, CPV2F, CPV3R, CPV3F, CPV4R, and CPV4F.

In exemplary embodiments, the control signal generator 230 may be configured to output the first, second, third, and fourth gate pulse signals CPV1, CPV2, CPV3, and CPV4 to enable the first, second, third, and fourth gate pulse signals CPV1, CPV2, CPV3, and CPV4 to be synchronized with the image data signal DATA, which is output from the timing controller 220. For instance, the image data signal DG1 is provided to the pixels PX via the data driver 250 while the gate line GL1 is driven by the first gate clock signal CKV1, which may be obtained by leveling up the first gate pulse signal CPV1. Similarly, the image data signal DG2 is provided to the pixels PX via the data driver 250 while the gate line GL2 is driven by the second gate clock signal CKV2, which may be obtained by leveling up the second gate pulse signal CPV2.

According to various exemplary embodiments, the control signal generator 230 is configured to generate the vertical synchronization start signal STVP and the first, second, third, and fourth gate clock signals CKV1, CKV2, CKV3, and CKV4 in response to the first and second data enable signals HDE1 and HDE2. In this manner, the timing controller 220 may be configured to only apply the first and second data enable signals HDE1 and HDE2 to the control signal generator 230. As a result, the timing controller 220 may be configured without a separate circuit block conventionally utilized to generate the vertical synchronization start signal STVP and the first, second, third, and fourth gate clock signals CKV1, CKV2, CKV3, and CKV4 and, as such, the size of the circuit and the number of pins associated with the timing controller 220 may be reduced. In turn, this reduction in size, complexity, and number of interworking components enables the display apparatus 100 to be more efficiently manufactured and at reduced cost.

According to exemplary embodiments, the control signal generator 230 may include an electrostatic discharge prevention circuit (not shown) configured to reduce various influences caused by, for instance, electrostatic discharge. According to exemplary embodiments, the control signal generator 230 may include one or more circuits configured to generate a common voltage utilized to drive the display panel 210 and one or more voltages utilized to drive the gate driver 240.

Figure 9:
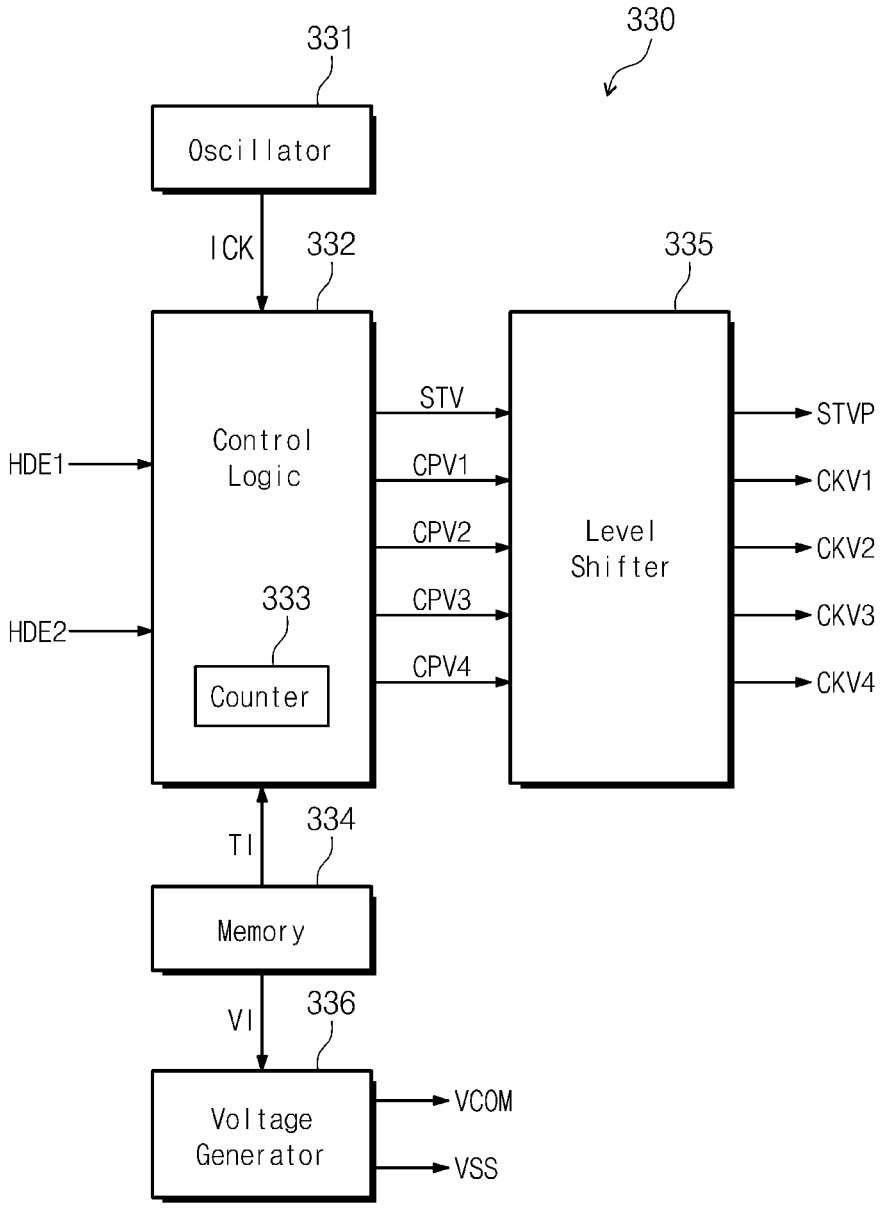
FIG. 9 is a block diagram of a control signal generator, according to exemplary embodiments.

FIG. 9 is a block diagram of a control signal generator, according to exemplary embodiments.

As shown, control signal generator 330 includes an oscillator 331, control logic 332, a memory 334, a level shifter 335, and a voltage generator 336. While specific reference will be made to this particular implementation, it is also contemplated that control signal generator 330 may embody many forms and include multiple and/or alternative components or features. For example, it is contemplated that the components of control signal generator 330 may be combined, located in separate structures, and/or separate locations. The oscillator 331, the control logic 332, the memory 334, and the level shifter 335 of the control signal generator 330 are operated similarly as the oscillator 231, the control logic 232, the memory 234, and the level shifter 235 of the control signal generator 230 of FIG. 7 and, therefore, corresponding detailed descriptions are not provided to avoid obscuring exemplary embodiments.

Accordingly, the voltage generator 336 is configured to generate a common voltage VCOM utilized to drive the display panel 210 and a gate off voltage VSS utilized to drive the gate driver 240. The voltage generator 336 is configured to generate the common voltage VCOM and the gate off voltage VSS so that each of the common voltage VCOM and the gate off voltage VSS exhibits a voltage level corresponding to voltage information VI stored in, for instance, the memory 334. The control signal generator 330, which includes the voltage generator 336, may be referred to as a merged voltage generator or a merged DC-DC converter.

Figure 10:
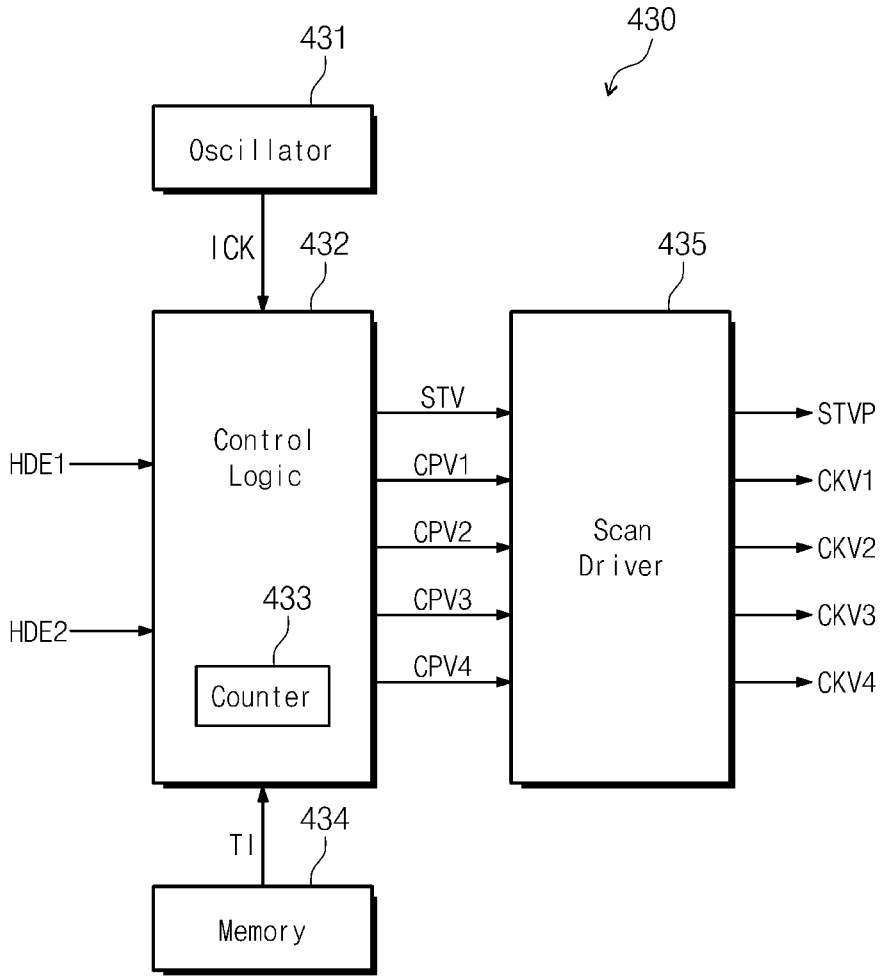
FIG. 10 is a block diagram of a control signal generator, according to exemplary embodiments.

FIG. 10 is a block diagram of a control signal generator, according to exemplary embodiments.

As seen in FIG. 10, a control signal generator 430 includes an oscillator 431, a control logic 432, a memory 434, and a scan driver 435. While specific reference will be made to this particular implementation, it is also contemplated that control signal generator 430 may embody many forms and include multiple and/or alternative components or features. For example, it is contemplated that the components of control signal generator 430 may be combined, located in separate structures, and/or separate locations.

According to various exemplary embodiments, the scan driver 435 is configured to convert the vertical synchronization signal STV and the first, second, third, and fourth gate pulse signals CPV1, CPV2, CPV3, and CPV4 received from the control logic 432 to exhibit a sufficient voltage level to drive the gate driver 240 of the display apparatus 200 of FIG. 5, as well as output the vertical synchronization start signal STVP and the first, second, third, and fourth gate clock signals CKV1, CKV2, CKV3, and CKV4. In addition, the scan driver 430 may be configured to generate the first, second, third, and fourth gate clock signals CKV1, CKV2, CKV3, and CKV4 to turn off the switching transistors, so that electrons charged in the pixel electrodes of the display panel 210 may be rapidly discharged when a power supply is turned off.

It will be apparent to those skilled in the art that various modifications and variations can be made without departing from the spirit or scope of the invention. Thus, it is intended that the present invention cover the modifications and variations provided they come within the scope of the appended claims and their equivalents.

What is claimed is:

1. A display apparatus comprising:

a plurality of gate lines;

a plurality of data lines that cross the plurality of gate lines;

a plurality of pixels each of which is connected to a corresponding gate line of the plurality of gate lines and a corresponding data line of the plurality of data lines;

a control signal generator configured to, in response to a data enable signal, generate a plurality of control signals;

a gate driver configured to drive the plurality of gate lines in response to at least one control signal among the plurality of control signals;

a data driver configured to drive the plurality of data lines; and a timing controller configured to:

control the data driver in response to at least one received image signal and at least one received image control signal, and apply the data enable signal to the control signal generator, wherein the control signal generator comprises:

a memory configured to store time information, the time information corresponding to a time difference between the data enable signal and each of a vertical synchronization signal, a first gate pulse signal, and a second gate pulse signal;

an oscillator configured to generate the inner clock signal;

a control logic configured to count the inner clock signal and compare the counted value and the time information to generate the vertical synchronization signal, the first gate pulse signal, and the second gate pulse signal; and a level shifter configured to convert the vertical synchronization signal, the first gate pulse signal, and the second gate pulse signal to the vertical synchronization start signal, a first gate clock signal, and a second gate clock signal, respectively.

2. The display apparatus of claim 1, wherein the control logic comprises a counter configured to count the inner clock signal and output the counted value.

3. The display apparatus of claim 2, wherein the time information comprises time information corresponding to a time difference between the data enable signal and a rising time point of each of the vertical synchronization signal, the first gate pulse signal, and the second gate pulse signal, and between the data enable signal and a falling time point of each of the vertical synchronization signal, the first gate pulse signal, and the second gate pulse signal.

4. The display apparatus of claim 1, wherein the timing controller is further configured to generate the data enable signal in synchronization with an enable signal received via the image control signal, the data enable signal comprising a first data enable signal and a second data enable signal.

5. The display apparatus of claim 4, wherein the control signals comprise a vertical synchronization start signal, a first gate clock signal, a second gate clock signal, a third gate clock signal, and a fourth gate clock signal.

6. The display apparatus of claim 5, wherein:

the time information corresponds to a time difference between each of the vertical synchronization signal, the first gate pulse signal, the second gate pulse signal, a third gate pulse signal, and a fourth gate pulse signal, and the first data enable signal and the second data enable signal;

the control logic is configured to count the inner clock signal and compare the counted value and the time information to further generate the third gate pulse signal and the fourth gate pulse signal; and the level shifter is further configured to convert the third gate pulse signal and the fourth gate pulse signal to the third gate clock signal and the fourth gate clock signal, respectively.

7. The display apparatus of claim 6, wherein the control logic comprises a counter configured to count the inner clock signal and output the counted value.

8. The display apparatus of claim 7, wherein the time information comprises time information corresponding to a time difference between the first data enable signal and the second data enable signal and a rising time point of each of the vertical synchronization start signal and the first gate pulse signal, the second gate pulse signal, the third gate pulse signal, and the fourth gate pulse signal, and between the first data enable signal and the second data enable signal and a falling time point of each of the vertical synchronization start signal, the first gate pulse signal, the second gate pulse signal, the third gate pulse signal, and the fourth gate pulse signal.

9. The display apparatus of claim 8, wherein the control logic is configured to:

generate the vertical synchronization start signal based on a rising edge of each of the first data enable signal and the second data enable signal and the time information;

generate the second gate clock signal and the fourth gate clock signal based on the rising edge of the first data enable signal and the time information; and generate the first gate clock signal and the third gate clock signal based on the rising edge of the second data enable signal and the time information.

10. The display apparatus of claim 4, wherein the time information, the time information corresponds to a time difference between each of the vertical synchronization signal, the first gate pulse signal, the second gate pulse signal, a third gate pulse signal, and a fourth gate pulse signal, and the first enable signal and the second data enable signal;

the control logic is configured to count the inner clock signal and compare the counted value and the time information to further generate the third gate pulse signal and the fourth gate pulse signal; and the level shifter is further configured to convert the third gate pulse signal and the fourth gate pulse signal to the third gate clock signal and the fourth gate clock signal, respectively.

11. The display apparatus of claim 4, wherein each of the first data enable signal and the second data enable signal exhibit a frequency the same as or an integer multiple of the enable signal, and the second data enable signal is phase-delayed from the first data enable signal.

12. A method to drive a display apparatus comprising a plurality of pixels, the method comprising:

receiving at least one data enable signal generated based on an enable signal associated with an image control signal;

generating an inner clock signal;

counting, in response to reception of the at least one data enable signal, the inner clock signal;

retrieving time information to compare with the counted inner clock signal;

comparing the counted inner clock signal with the time information;

generating, based on the comparison, a vertical synchronization signal and at least two gate pulse signals;

converting the vertical synchronization signal and the at least two gate pulse signals into a vertical synchronization start signal and at least two gate clock signals, respectively; and driving the plurality of pixels based on the vertical synchronization start signal and the at least two gate clock signals, wherein the at least one data enable signal is two data enable signals, the at least two gate pulse signals are four gate pulse signals, and the at least two gate clock signals are four gate clock signals, and wherein generating the vertical synchronization start signal and the four gate clock signals comprises:

generating the vertical synchronization start signal based on a rising edge of each of a first data enable signal and a second data enable signal and the time information;

generating a first gate clock signal and a third gate clock signal based on the rising edge of the second data enable signal and the time information; and generating a second gate clock signal and a fourth gate clock signal based on the rising edge of the first data enable signal and the time information.

13. The method of claim 12, wherein the vertical synchronization start signal and the at least two gate clock signals are utilized to drive a plurality of gate lines correspondingly coupled to the plurality of pixels.

14. The method of claim 12, wherein each of the at least two data enable signals exhibit a frequency the same as or an integer multiple of the enable signal, and at least one of the at least two data enable signals is phase-delayed from at least one other one of the at least two data enable signals.

15. The method of claim 12, wherein the time information comprises time information corresponding to a time difference between the at least one data enable signal and a rising time point of each of the vertical synchronization start signal and the at least two gate pulse signals, and between the at least one data enable signal and a falling time point of each of the vertical synchronization start signal and the at least two gate pulse signals.

* * * * *